US005382763A

United States Patent [19]

Martus et al.

[11] Patent Number: 5,382,763

[45] Date of Patent: Jan. 17, 1995

[54] ELECTRICAL SWITCH FOR AUTOMOTIVE VEHICLE DECK LID LATCHES

[75] Inventors: Charles R. Martus, Troy; Charles A. Detweiler, Durand, both of Mich.

[73] Assignee: Lectron Products, Inc., Rochester Hills, Mich.

[21] Appl. No.: 127,752

[22] Filed: Sep. 27, 1993

[51] Int. Cl.[6] ..... H01H 3/00

[52] U.S. Cl. ..... 200/61.62; 200/61.64; 200/283

[58] Field of Search ..... 200/61.62–61.83, 200/239–251, 275–289

[56] References Cited

U.S. PATENT DOCUMENTS

| | | | |
|---|---|---|---|
| 1,024,972 | 4/1912 | Brewster | 200/61.62 |
| 3,857,001 | 12/1974 | Quantz | 200/61.64 |
| 4,468,545 | 8/1984 | Slavin | 200/61.64 |
| 4,971,370 | 11/1990 | Detweiler et al. | 292/45 |

*Primary Examiner*—J. R. Scott

*Attorney, Agent, or Firm*—Harness, Dickey & Pierce

[57] ABSTRACT

The present invention provides an electrical switch that is adapted to compensate for dimensional variations in the alignment between a resilient switch member and a movable actuation member. To this end, the electrical switch has general utility but is primarily intended for use in automotive applications. More specifically, the improved electrical switch is incorporated into a latching mechanism for controlling an electrical circuit that is provided for indicating whether the latching mechanism is in a latched or an unlatched condition. The electrical switch has a pair of overlapping and offset terminal blades and further includes a biasing arrangement for biasing each terminal blade into a predetermined alignment relative to the other. The biasing arrangement is further operable for biasing both blades relative to the movable actuation member of the latch mechanism. The actuation member is made of an electrically insulative material and has a reference surface which, due to the preload biasing exerted on the terminal blades, is maintained in continuous engagement with at least one of the terminal blades during movement of the actuation member.

15 Claims, 4 Drawing Sheets

ELECTRICAL SWITCH FOR AUTOMOTIVE VEHICLE DECK LID LATCHES

BACKGROUND AND SUMMARY OF THE INVENTION

The present invention relates generally to electrical switches and, in particular, to an electric switch having offset terminal blades that are biased relative to an actuation member to compensate for dimensional variations therebetween.

As is known, motor vehicles are equipped with a plurality of latching mechanisms that are each operable for releasably latching a movable body segment (i.e., the deck lid, the hood, the passenger doors, the fuel-filler door and the like)in a closed position. Moreover, such latching mechanisms can be selectively unlatched for permitting subsequent movement of the body segment toward an open position.

As a convenience feature, it is common to incorporate an electrical switch into the latching mechanism for causing an auxiliary lamp and/or an indicator light in the passenger compartment to be illuminated in response to unlatching of the latch mechanism. In most applications, the electrical switch has at least one elongated terminal blade which is cantilevered from a plug-in type electrical connector. When the latching mechanism is latched and the vehicular body segment is held in the closed position, an electrically conductive actuation member is displaced from the terminal blade such that an open electrical circuit is maintained. However, upon the latching mechanism being unlatched for releasing the vehicular body segment, the actuation member is forcibly urged into engagement with the terminal blade for closing the electrical circuit and illuminating the auxiliary lamp and/or indicator light. Examples of conventional blade-type electrical switches of the type used in automotive latching systems are shown and described in U.S. Pat. Nos. 4,468,545 and 4,971,370, both of which have a common assignee with the present invention.

While most conventional blade-type electrical switches work well for their intended purpose, they are typically exposed to relatively large impact forces that are exerted thereon by the actuation member each time the latching mechanism is unlatched. Thus, the terminal blades must be designed and constructed to withstand severe cyclical impact loading without experiencing premature fatigue and yet be small in size and economical to manufacture. Unfortunately, such conventional switches must also be designed to compensate for anticipated dimensional and assembly-related variations in the alignment of the actuation member relative to the cantilevered terminal blade, as well as for deflection due to external forces applied to the electrical connector. As such, the need exists to develop an electrical switch which overcomes the above-noted tolerance and alignment variability and yet provides superior life and operational durability.

Accordingly, it is a primary object of the present invention to provide an electrical switch having means for compensating for dimensional variations in the alignment between a resilient switch member and a movable actuation member. To this end, the present invention is directed to an improved electrical switch having general utility but primarily intended for use in automotive applications. More specifically, the improved electrical switch of the present invention is incorporated into a latching mechanism for controlling an electrical circuit that is provided for indicating whether the latching mechanism is in a latched or an unlatched condition. In a preferred form, the electrical switch is adapted to cause an auxiliary lamp and/or an indicator light to be illuminated in response to the latching mechanism being placed in its unlatched condition.

The electrical switch of the present invention has a pair of overlapping and offset terminal blades and further includes means for biasing each terminal blade into a predetermined alignment relative to the other. The biasing arrangement is further operable for biasing both blades relative to a movable actuation member of the latching mechanism. In this manner, alignment variations between the actuation member and the terminal blades are eliminated as the actuation member is caused to move between a first (i.e., "circuit open") position and a second (i.e., "circuit closed") position.

As a related object, the actuation member is made of an electrically insulative material and has a reference surface which, due to the pre-load biasing exerted on the terminal blades, is maintained in continuous engagement with at least one of the terminal blades during movement of the actuation member. In a preferred form, the distal end of one of the cantilevered terminal blades is offset and overlapping relative to the distal end of the other cantilevered terminal blade. When the actuation member is in the first position, the reference surface engages an intermediate portion of both terminal blades for maintaining the offset spacing so as to establish a non-contacting relationship therebetween. Upon movement of the actuation member toward the second position, the reference surface acts on the offset portion of the one terminal blade for resiliently biasing it into contact with the underlying distal end portion of the other terminal blade, thereby closing an electric circuit therebetween.

Thus, the improved electrical switch is designed and constructed to withstand the typical physical abuse and rough treatment to which it is commonly subjected during use over long periods of time. Moreover, the improved electrical switch is small in size and is adaptable to many different environmental conditions. Also, the improved electrical switch is inexpensive to manufacture and easy to install.

Additional advantages and features of the present invention will become apparent from the following description and appended claims, taken in conjunction with the accompanying drawings.

DETAILED DESCRIPTION OF THE PREFERRED EMBODIMENTS

In general, the present invention is related to a new and useful improvement in electrical switches and, more particularly, to a pre-loaded blade-type electrical switch which is adapted to compensate for dimensional and alignment variations commonly associated with use in motor vehicle latching systems. More particularly, the improved electrical switch of the present invention finds particular application with a deck lid latching mechanism for controlling an electrical circuit that is provided for illuminating a trunk lamp and/or an indicator light provided within the passenger compartment. However, while the following description discloses the improved electrical switch in association with an automotive deck lid latching mechanism, it is to be understood that the novel principles of the present invention permit its use in virtually any automotive switch application.

Figure 1:
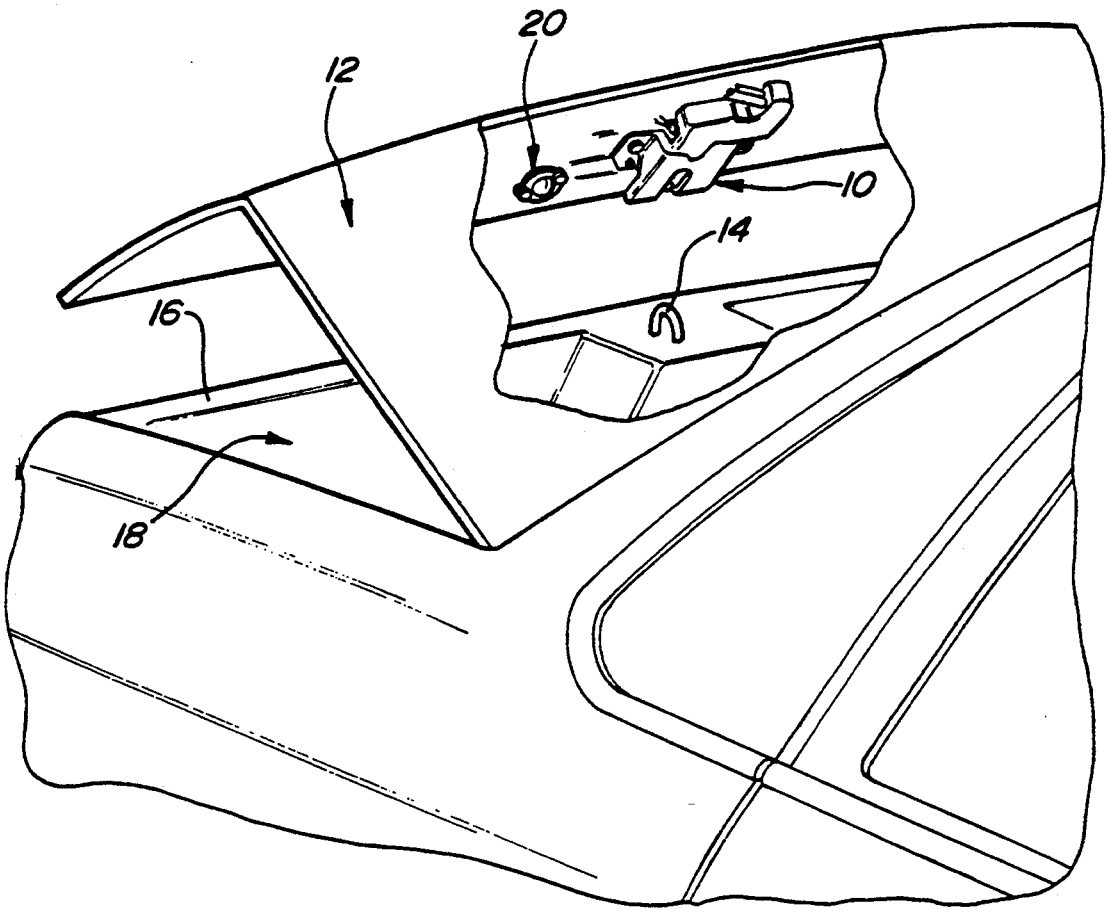
FIG. 1 is a partial perspective view of an exemplary motor vehicle showing a deck lid latching mechanism incorporating an improved electrical switch according to a preferred embodiment of the present invention.

Referring to FIG. 1, a latching mechanism 10 is shown attached to a deck lid 12 such that it can operably engage a striker bar 14 that is affixed to an end panel 16 of an automotive vehicle truck 18. As is known to those skilled in the art, the orientation between latching mechanism 10 and striker bar 14 can be reversed depending on the particular vehicular application. A trunk lamp 20 is also shown attached to the inside of deck lid 12 for illuminating the inside of trunk 18. As will be detailed, latching mechanism 10 has an improved electrical switch which is operable in a first mode for illuminating lamp 20 in response to deck lid 12 being unlatched (i.e., open), and a second mode for extinguishing lamp 20 when deck lid 12 is latched (i.e., closed).

Figure 2:
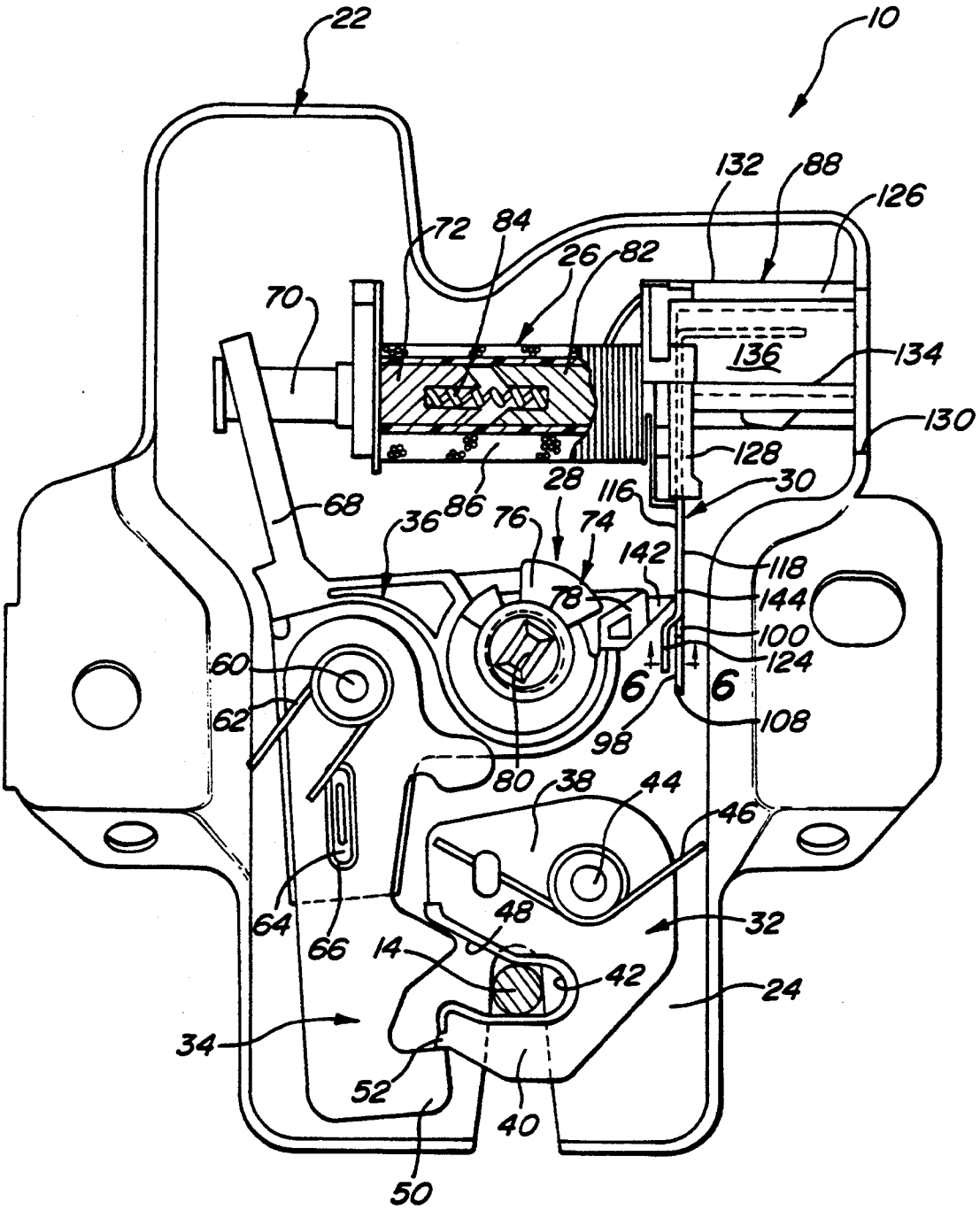
FIG. 2 is a front elevation view of the deck lid latching mechanism shown in FIG. 1 illustrating a striker cam in a latched position and the electrical switch in an open circuit position.
Figure 3:
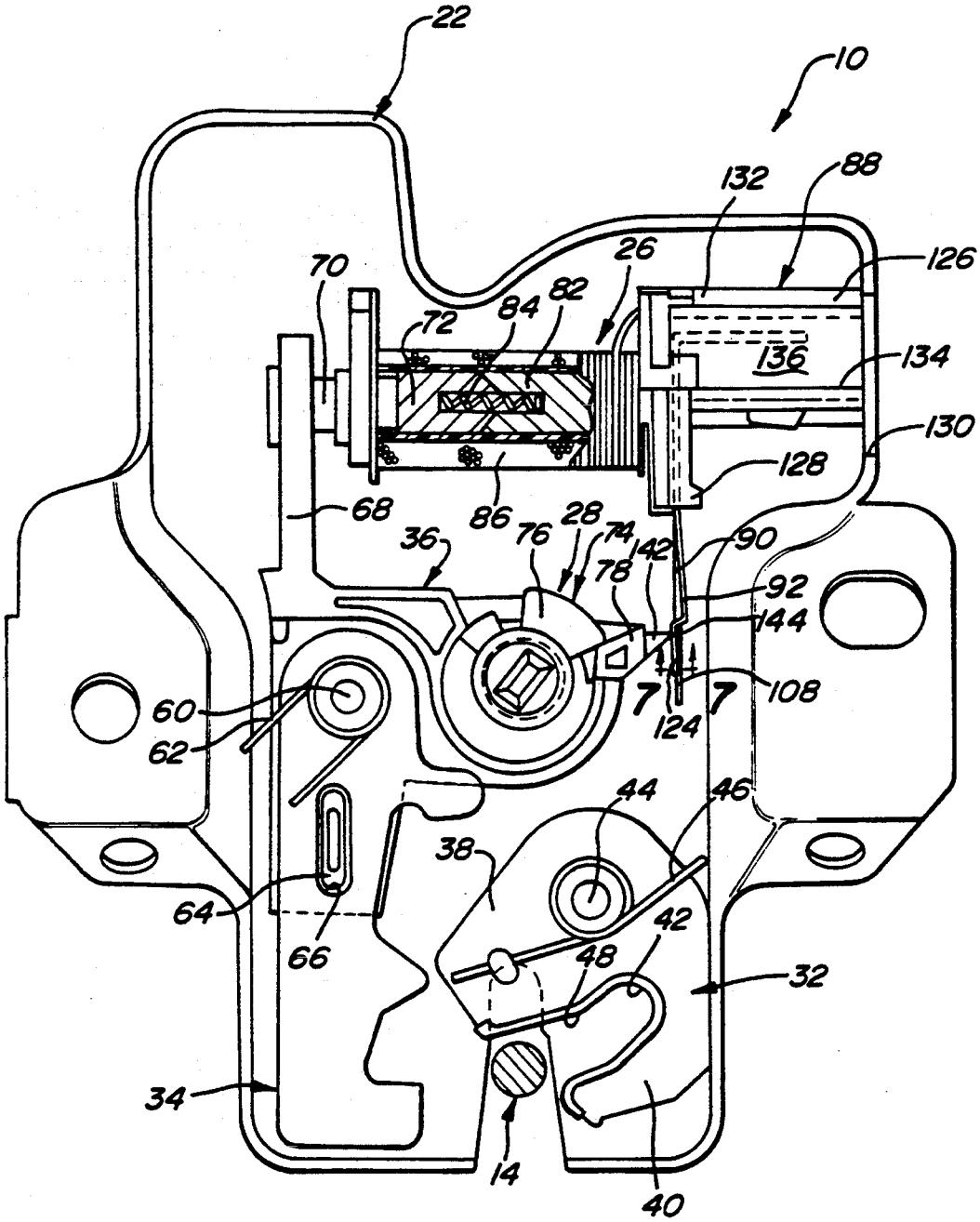
FIG. 3 is a front elevation view of the deck lid latching mechanism shown in FIG. 1 illustrating the striker cam in a unlatched position and the electrical switch in a closed circuit position.
Figure 4:
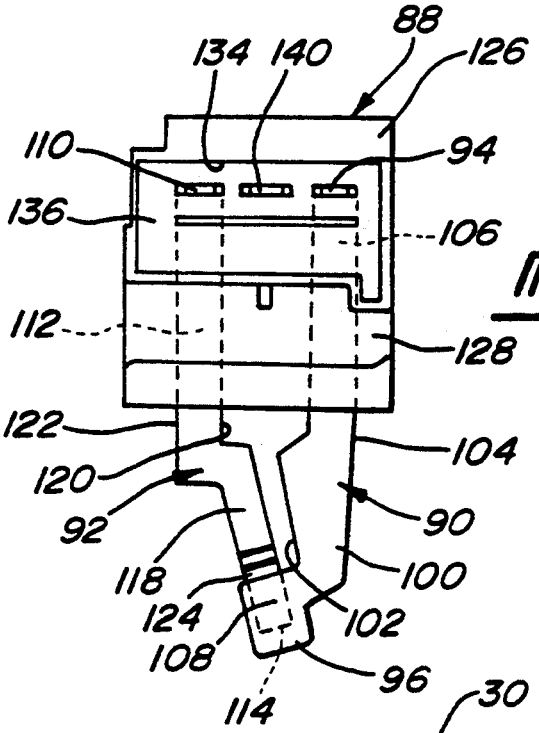
FIG. 4 is a side elevation view of the electrical switch shown in FIGS. 2 and 3.

With particular reference now to FIGS. 2 and 3, latching mechanism 10 is shown in greater detail. In general, latching mechanism 10 includes a mounting plate 22 which forms the structural support for the remaining components, a spring-biased latch arrangement 24 engageable with striker bar 14, an electrically-controlled actuator 26 for permitting remote release of striker bar 14, a manually-operable actuator 28 for permitting independent and direct release of striker bar 14, and the novel electrical switch 30 of the present invention. In FIG. 2, latch arrangement 24 is shown with striker bar 14 in a "latched" condition whereby deck lid 12 is closed and latched relative to trunk 18. Alternatively, FIG. 3 shows latch arrangement 24 in an "unlatched" condition with striker bar 14 released, whereby deck lid 12 can be freely moved to an open position for providing access to trunk 18. From the construction shown, latch arrangement 24 includes a generally C-shaped striker cam 32, an elongated latch lever 34, and a pawl 36 coupled for concurrent pivotable movement with latch lever 34. Striker cam 32 includes a first leg 38 and a second leg 40 which together define a cavity 42 therebetween. Striker cam 32 is pivotably affixed about a pivot 44 and is normally biased toward the FIG. 3 unlatched position by a torsion spring 46. In operation, striker cam 32 is rotated clockwise from the unlatched position of FIG. 3 to the latched position of FIG. 2 upon engagement of striker bar 14 with a camming surface 48 formed on an edge surface of first leg 38. As seen, a shoulder projection 50 at the distal end of latch lever 34 is adapted to capture a hooked end 52 on second leg 40 of striker cam 32 for retaining striker cam 32 in the latched position in opposition to the biasing exerted thereon by torsion spring 46.

With continued reference to FIGS. 2 and 3, latch lever 34 and pawl 36 are shown fixed to base plate 22 for pivotable movement about a pivot 60. In addition, a torsion spring 62 is provided for normally urging latch lever 34 and pawl 36 toward the latched position of FIG. 2. In the preferred construction, pawl 36 is molded from an electrically insulative material, such as a polymeric resin. One preferred material of choice is a glass-filled nylon 6/6 material. As seen, pawl 36 has an elongated post 64 which is retained with a groove 66 formed in latch lever 34 for coupling the components for concurrent pivotable movement about pivot 60. In addition, pawl 36 includes an arm extension 68 which is coupled to a plunger 70 of a movable armature 72 that is associated with electrically-controlled actuator 26. As will be described, actuation of electrically-controlled actuator 26 causes plunger 70 to be retracted for forcibly acting on arm extension 68, whereby pawl 36 and latch lever 34 are caused to pivot about pivot 60 in a clockwise direction for releasing hooked end 52 of striker cam 32 from shoulder projection 50 of latch lever 36. In this manner, striker cam 32 is released such that torsion spring 46 biasingly urges striker cam 32 to pivot about pivot 44 from the latched position of FIG. 2 to the unlatched position of FIG. 3 for releasing striker bar 14 from cavity 42.

Pawl 36 is also adapted to operably support manually-operable actuator 28. Preferably, manually-operable actuator 28 is a key actuator 74 that is journalled with a bore in pawl 36 and has a cam tab 76 that is selectively engageable with a lug 78 of pawl 36 for directly and mechanically rotating pawl 36 and latch lever 34 about pivot 60 in a manner releasing striker cam 32. In addition, key actuator 74 includes a receptacle 80 which is adapted to receive a car key for permitting the vehicle operator to intentionally rotate cam tab 76 into contact with pawl lug 78 for releasing striker cam 32. Thus, latching mechanism 10 can either be remotely actuated via actuation of electrically-controlled actuator 26 or directly actuated upon insertion and rotation of a car key into key actuator 74.

Electrically-controlled actuator 26 is preferably an electromagnetic solenoid device of a known construction and includes a stationary pole piece 82, axially movable armature 72 and a spring 84 for normally biasing armature 72 (and plunger 70) away from pole piece 82. A coil winding 86 surrounds pole piece 82 and a portion of armature 72. As noted, plunger 70 is coupled to armature 72 for concurrent axial movement therewith between the non-energized position of FIG. 2 and the energized position of FIG. 3. A suitable electrical connector 88 is provided for enabling convenient "push-in" connection to the vehicles wiring harness for supplying the requisite current to coil windings 86 when it is desired to remotely operate latching mechanism 10. While the above discloses a specific latching mechanism 10 to which incorporation of improved electrical switch 30 is readily accomplished, it is to be understood that the following disclosure of the new and useful principles and features associated with electrical switch 30 could be incorporated into virtually any other suitable latching mechanism for controlling an electric circuit.

According to a preferred embodiment of the present invention, electrical switch 30 is comprised of a first electrically conductive terminal blade 90 and a second electrically conductive terminal blade 92 which are cantilevered to extend in a generally "side-by-side" relationship from electrical connector 88. First terminal blade 90 has a connector end 94 and an opposite distal end 96. These ends 94 and 96 are joined by a pair of substantially flat faces 98 and 100, an inside edge 102 and an outside edge 104. In addition, connector end 94 is bent generally orthogonally in relation to an intermediate segment 106 of first terminal blade 90. Moreover, an enlarged projection 108 is formed at distal end 96 of first terminal blade 90 which is generally coplanar with intermediate segment 106.

Second terminal blade 92 similarly has a connector end 110, an intermediate segment 112 and a distal end 114. These ends are joined by a pair of faces 116 and 118, an inside edge 120 and outside edge 122. Furthermore, connector end 110 of second terminal blade 92 is bent generally orthogonally in relation to intermediate segment 112. Also, a lower portion 124 is stepped away (i.e., offset) from its intermediate segment 112 such that an offset plane is created by lower stepped portion 124 which is substantially parallel with the longitudinal plane created by intermediate segment 112. Both first and second terminal blades 90 and 92, respectively, are preferably made from a stamped half-hard beryllium copper alloy. However, any suitable metallic material providing the requisite high electrical conductivity and resilient flexural properties can likewise be used.

To provide means for accepting receipt of the "push-in" connector (not shown) of the wiring harness, electrical connector 88 is formed to include a mating segment 126 and a retaining segment 128 therebelow. Electrical connector 88 is preferably made of a suitable electrically insulating plastic material, such as nylon or the like, that can be molded relatively inexpensively to a desired shape and retain its physical shape and dimensions under normal conditions of use. Mating segment 126 is generally orthogonal in relation to retaining segment 128 and is positioned to correspond with an opening 130 formed in an upstanding side wall portion of mounting plate 22. It is contemplated that connector 88 be provided with alignment means which coact with portions of mounting plate 22 for assisting in locating and holding electrical switch 30 in a proper alignment with respect to pawl 36. Furthermore, mating segment 126 of electrical connector 88 has a substantially rectangular inside surface 134 for defining a receptacle cavity 136 therein. Connector ends 94 and 110 of first and second electrical terminals 90 and 92, respectively, are located within cavity 136 and extend in a common plane toward opening 130. Since connector ends 94 and 110 of terminal blades 90 and 92 are adapted for push-in connection with a conventional female plug, it is desireable to retain these ends to inhibit undesirable longitudinal movement thereof. Furthermore, a third electrical terminal 140 is juxtapositioned between first terminal blade 90 and second terminal blade 92 within cavity 136 for supplying power to solenoid actuator 26. As noted, a wiring harness (not shown) is operably connected to mating segment 126, thereby providing electrical power to coil winding 86 of solenoid actuator 26 as well as to an electrical circuit between first and second terminal blades 90 and 92, respectively. Moreover, retaining segment 128 of electrical connector 88 surrounds and retains portions of intermediate segments 106 and 112 of first and second terminal blades 90 and 92, respectively. As will be described, each of terminal blades 90 and 92 is biased into engagement with an actuation segment of pawl 36 for minimizing alignment variations therebetween.

To provide means for compensating for dimensional and assembly-related alignment variations between terminal blades 90 and 92 and pawl 36, electrical switch 30 is adapted to bias each terminal blade into continuous engagement with an electrically insulative actuation segment of pawl 36. As best seen from FIGS. 2 and 3, pawl 36 includes an actuation lug 142 against which terminals 90 and 92 are biased due to their respective intermediate segments 106 and 112 being pre-loaded (i.e., resiliently deflected) by retaining segment 128 of electrical connector 88. More particularly, actuation lug 142 defines a reference surface 144 which is adapted to concurrently engage face surface 98 of first terminal blade 90 and face surface 116 of second terminal blade 92 when latching mechanism 10 is in the latched position of FIG. 2. Such concurrent engagement acts to maintain a relatively constant "gap" width or clearance between the overlapping distal ends of terminal blades 90 and 92 to inhibit the unintentional and intermittent closure of the electrical circuit. However, once pawl 36 and latch lever 34 are pivotably displaced for releasing striker cam 32, actuation lug 142 is also caused to pivot such that reference surface 144 cams over lower stepped portion 124 of second terminal blade 92. Such "camming" action results in lower stepped portion 124 of second terminal blade 92 being resiliently deflected into contacting engagement with first terminal blade 90, thereby closing the electrical circuit to illuminate lamp 20.

Preferably, when latching mechanism is unlatched, actuation lug 142 also causes a slight deflection of distal end 96 of first terminal blade 90 in addition to the deflection of distal end 114 of second terminal blade 92 so as to ensure maintained closure of the electrical circuit by switch 30. As will be appreciated, the pre-load applied to both terminal blades 90 and 92 for maintaining engagement with pawl actuation lug 142 is adapted to effectively eliminate alignment problems of the type commonly associated with conventional switch arrangements. As an alternative to terminal blades 90 and 92 being biased into engagement with pawl actuation lug 142, it is contemplated that actuation lug 142 may be slightly over-sized to exert a pre-load on terminal blades 90 and 92 for resiliently deflecting both of them from an unloaded position when striker cam 32 is in its latched position. In either case, dimensional variability between each terminal blade as well as any variability attributable to torquing of electrical connector 88 and/or assembly alignment of pawl 36 can be eliminated to promote superior service and prolonged life. Thus, terminal blades 90 and 92 are durable for withstanding repeated resilient actuation by pawl 36 without fracture or permanent deformation thereof while providing a good electrical connection when switch 30 is actuated. Moreover, due to the long cantilevered orientation of the terminal blades, the portions thereof that are engageable with each other to close the electrical connection provide a desireable soft action for readily absorbing the sharp, abrupt impact forces imposed thereon by pawl actuator lug 142.

Figure 6:
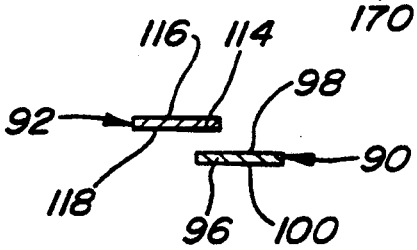
FIG. 6 is an end view taken along line 6—6 of FIG. 2 showing the spatial non-contacting alignment between the distal ends of the terminal blades that is associated with the electrical switch in the open circuit position.
Figure 7:
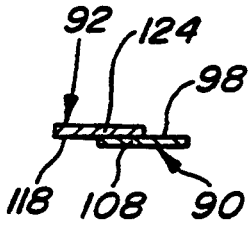
FIG. 7 is an end view taken along line 7—7 of FIG. 3 showing the contacting engagement between the distal ends of the terminal blades of the electrical switch in the closed circuit position.
Figure 8:
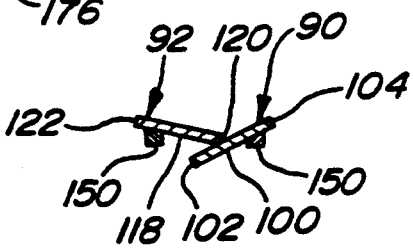
FIG. 8 is an end view, similar to FIG. 7, of an alternative embodiment of the electrical switch showing the distal ends of a pair of electrical terminal blades in a closed circuit position.

As is shown in FIG. 6, distal ends 96 and 114 of first and second terminal blades 90 and 92, respectively, are shown spatially displaced away from each other and exerted in planes that are substantially parallel to one another. As noted, this spatial positioning is established by the stepped offset portion 124 of second terminal 92 and is maintained by engagement of reference surface 144 of actuation lug 142 with the intermediate segment of each terminal blade. These distal ends 96 and 114, and the overlapping lower portions 108 and 124, evenly contact each other along face surfaces 98 and 118 when switch 30 is in the closed position, as illustrated in FIG. 7. Alternatively, referring to FIG. 8, a pair of stops 150 can be molded to extend integrally from retaining segment 128 of electrical connector 88. More specifically, stops 150 are formed to extend adjacent to face surfaces 100 and 118 and be generally proximate to outside edges 104 and 122 of first and second terminal blades 90 and 92, respectively. This causes inside edges 102 and 120 to tip inward toward each other when first and second terminal blades 90 and 92, respectively, are compressed together upon the camming action of pawl actuation lug 142. This ensures a very reliable wiping contact motion between terminals 90 and 92. In either case, when pawl 36 and latch lever 34 are pivoted to release striker cam 32 for pivotable movement from its latched position toward its unlatched position, actuator lug 142 on pawl 36 compresses lower stepped portion 124 of second terminal 92 for forcing face surface 118 of second terminal blade 92 against the adjacent face surface 98 of first terminal blade 90.

Figure 5:
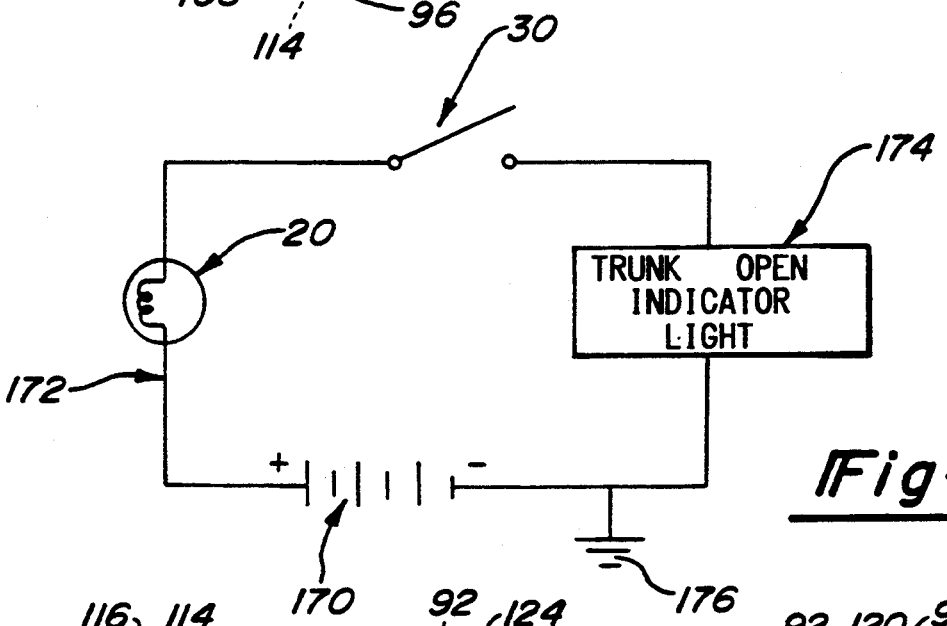
FIG. 5 is a circuit diagram for the electrical switch of the present invention.

An exemplary circuit diagram is shown in FIG. 5. A DC battery 170 is connected in series to an electrical circuit 172, trunk lamp 20, switch 30, indicator light 174 and to a ground 176. When switch 30 is in the closed position due to engagement of terminal blades 90 and 92, trunk lamp 20 and indicator light 174 are illuminated.

While the preferred embodiments of the present invention electrical switch for use with a latching mechanism has been disclosed, it will be appreciated that various modifications may be made without departing from this present invention. For example, pawl 36 and actuator lug 142 may traverse linearly rather than rotate. Furthermore, pawl 36 and latch lever 34 may be combined into a single electrically insulative component. Moreover, while latching mechanism 10 is shown to include a solenoid actuator 26, a mechanical (i.e., key-type) actuator may be the sole means for actuation of electrical switch 30 and striker cam 32. While various materials have been disclosed in an exemplary fashion, other materials may of course be employed. It is intended by the following claims to cover these and any other departures from the disclosed embodiments which fall within the true spirit of this invention.

What is claimed is:

1. An electrical switch for use in an automotive vehicle in combination with a latching device, said electrical switch comprising:

an electrically insulative connector casing;

a first electrical terminal blade extending from said casing;

a second electrical terminal blade extending from said casing and having its distal end portion overlapping and offset from a distal end portion of said first terminal blade to establish a clearance therebetween for defining an open switch position; and an electrically insulative actuator that is movable between a first position engaging an intermediate portion of both of said first and second terminal blade to maintain said clearance therebetween, and a second position acting on said offset distal end of said second terminal blade to resiliently deflect it into engagement with said distal end of said first terminal blade for defining a closed switch position.

2. The electrical switch of claim 1 wherein said connector casing includes means for exerting a pre-load on said intermediate portion of each of said first and second terminal blades for biasing said terminal blades into engagement with said actuator.

3. The electrical switch of claim 1 further comprising means for moving said actuator from said first position to said second position in response to said latching device being selectively shifted from a latched condition to an unlatched condition.

4. The electrical switch of claim 3 further comprising means for generating an electrical current and an electrical circuit connected in series therewith, said switch being operable in said closed switch position to permit electrical current to flow through said circuit and in said open switch position to interrupt the flow of electrical current through said circuit.

5. The electrical switch of claim 4 wherein said electrical circuit includes an illumination device which is illuminated when said switch is in said closed switch position and extinguished when said switch is in said open switch position.

6. The electrical switch of claim 1 wherein said first terminal blade has an elongated planar shape with a connector end retained in said casing and an enlarged projection formed at its distal end, and wherein said second terminal blade has a connector end retained in said casing and a stepped portion formed at its distal end, said stepped portion of said second terminal blade oriented to overlap said enlarged projection of said first terminal blade and be generally parallel therewith to establish said clearance therebetween.

7. The electrical switch of claim 6 wherein said first terminal blade and said second terminal blade are located alongside one another with said intermediate portions thereof being aligned along a common plane.

8. The electrical switch of claim 7 wherein when said switch is in said closed position said actuator compresses said stepped lower portion of said second terminal blade against said projection portion of said first terminal blade.

9. The electrical switch of claim 8 wherein said casing further comprises a mating segment and a retaining segment, said mating segment having an outside surface and an inside surface defining a cavity therein with an opening at one end thereof, said connector end portions of said first and second terminal blades being positioned within said cavity of said connector casing and extending toward said opening therein, and a portion of said intermediate portions of said first and second terminal blades being encased and retained within said retaining portion of said connector casing.

10. The electrical switch of claim 9 further comprising a pair of stops being positioned proximate to said retaining segment of said connector casing, each of said stops being juxtapositioned along outside edges of said first and second terminal blades, said stops acting to angle said inside edges of said first and second terminal blades toward one another when said actuator compresses said second terminal blade against said first electrical terminal blade.

11. The electrical switch of claim 3 wherein said means for moving said actuator further comprises a solenoid having a coil winding, a pole piece and a movable armature, said armature being coupled to said actuator for causing said actuator to move from said first position to said second position upon energization of said solenoid coil winding.

12. The electrical switch of claim 11 wherein said actuator is moved from said second position to said first position by de-energizing said solenoid and latching said latching device.

13. The electrical switch of claim 12 wherein said latching device further comprises:

a pawl supported for rotation with respect to a mounting plate, said actuator being attached to a portion of said pawl and being concurrently moved therewith, said pawl being coupled to said armature whereby energization of said solenoid coil winding causes said armature to act on said pawl for rotating said pawl and said actuator from said first position to said second position;

means for biasing said pawl so as to urge said pawl toward said first position;

a striker cam supported for pivotable movement from said mounting plate from a latched position to an unlatched position, said striker cam having a first arm and a second arm which define a cavity therein, said cavity acting to engagedly capture a striker bar when in said latched position, said striker cam being restricted from rotating to said unlatched position when engaged with said pawl, said striker cam being free to rotate to said unlatched position when said pawl is disengaged therefrom; and striker cam biasing means for biasing said striker cam toward said unlatched position.

14. The electrical switch of claim 13 wherein said latching device is a deck lid latch for securing a deck lid upon a trunk of said automotive vehicle.

15. The electrical switch of claim 1 wherein said latching device further comprises a key journal rotatably mounted upon a mounting plate and having a cam tab engageable with said actuator to urge said actuator to said second position.

* * * * *